US005315325A

United States Patent [19]

Strouth

[11] Patent Number: 5,315,325

[45] Date of Patent: May 24, 1994

[54] LASER PRINTER CARTRIDGES

[75] Inventor: James W. Strouth, Simsbury, Conn.

[73] Assignee: Recycling Technologies International Corporation, Springfield, Mass.

[21] Appl. No.: 747,552

[22] Filed: Aug. 20, 1991

[51] Int. Cl.[5] ..... G03G 21/00

[52] U.S. Cl. ..... 346/160.1; 355/246

[58] Field of Search ..... 355/246, 251, 253, 259; 118/657, 658; 346/160.1

[56] References Cited

U.S. PATENT DOCUMENTS

| | | | |
|---|---|---|---|
| 3,219,014 | 11/1965 | Mott et al. | 355/251 |
| 4,030,823 | 6/1977 | Brugger et al. | 355/8 |
| 4,084,542 | 4/1978 | Okada et al. | 118/658 |
| 4,511,239 | 4/1985 | Kanbe et al. | 355/3 DD |
| 4,545,669 | 10/1985 | Hays et al. | 355/3 R |
| 4,555,172 | 11/1985 | Mogi | 355/246 |
| 4,743,942 | 5/1988 | Yamamoto et al. | 355/3 DD |
| 4,797,704 | 1/1989 | Williams et al. | 355/246 |
| 4,806,097 | 2/1989 | Palm et al. | 432/60 |
| 4,816,870 | 3/1989 | Nagayama | 355/3 DD |
| 4,844,008 | 7/1989 | Sakemi et al. | 118/658 |
| 4,848,267 | 7/1989 | Slayton et al. | 118/653 |
| 4,885,222 | 12/1989 | Kaneko et al. | 430/102 |
| 4,891,671 | 1/1990 | Iwamasa | 355/245 |
| 4,891,675 | 1/1990 | Asanuma | 355/246 |
| 4,911,100 | 3/1990 | Yamashita | 118/658 |
| 4,941,019 | 7/1990 | Honda et al. | 355/251 |
| 4,982,691 | 1/1991 | Asanuma et al. | 118/658 |
| 4,989,045 | 1/1991 | Slayton et al. | 355/260 |
| 4,994,853 | 2/1991 | Fukuchi et al. | 355/208 |
| 4,996,566 | 2/1991 | Morita et al. | 355/246 |
| 5,049,941 | 9/1991 | Manno et al. | 355/260 |
| 5,051,782 | 9/1991 | Yamaji | 355/251 |
| 5,070,812 | 12/1991 | Yamaji | 118/658 |
| 5,129,357 | 7/1992 | Yamaji | 355/245 X |

FOREIGN PATENT DOCUMENTS

| | | |
|---|---|---|
| 0212669A2 | 3/1987 | European Pat. Off. . |
| 0311020A2 | 4/1989 | European Pat. Off. . |
| 0418823A2 | 9/1990 | European Pat. Off. . |

*Primary Examiner*—Benjamin R. Fuller
*Assistant Examiner*—Randy W. Gibson
*Attorney, Agent, or Firm*—Wolf, Greenfield & Sacks

[57] ABSTRACT

A laser printer cartridge comprising including: a housing; a photosensitive drum; a developer cylinder including an inner magnetic member and a coaxial outer sleeve, the internal magnetic member being adjustably mounted on the housing and the outer sleeve being mounted so as to allow rotation about the common axis of the internal magnetic member and the outer sleeve; and means for adjusting the angular position of said internal magnetic member with respect to the housing.

28 Claims, 5 Drawing Sheets

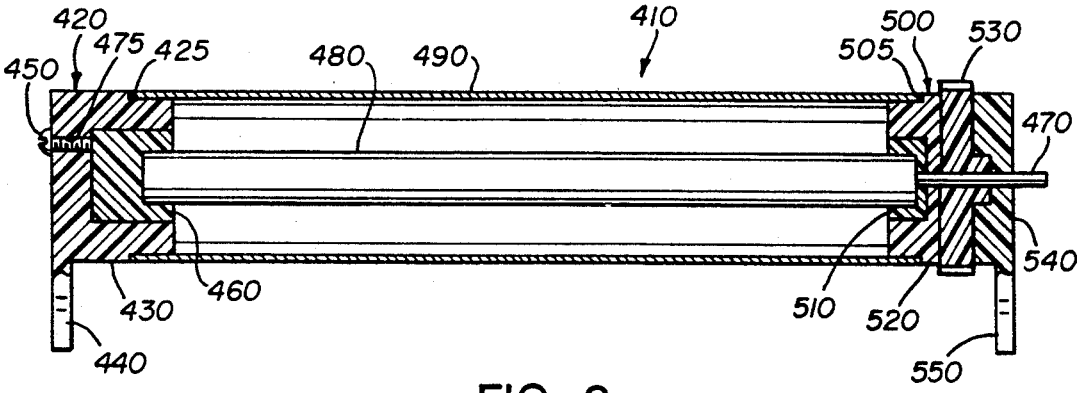
FIG. 3
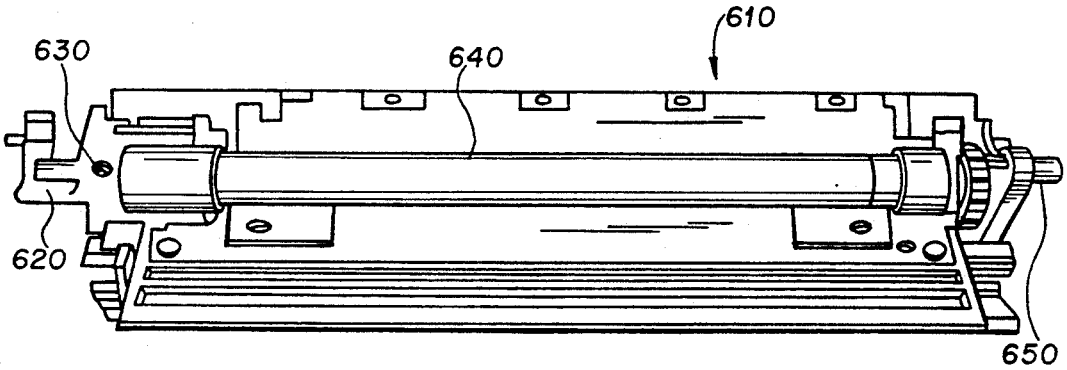
FIG. 4a
FIG. 4b
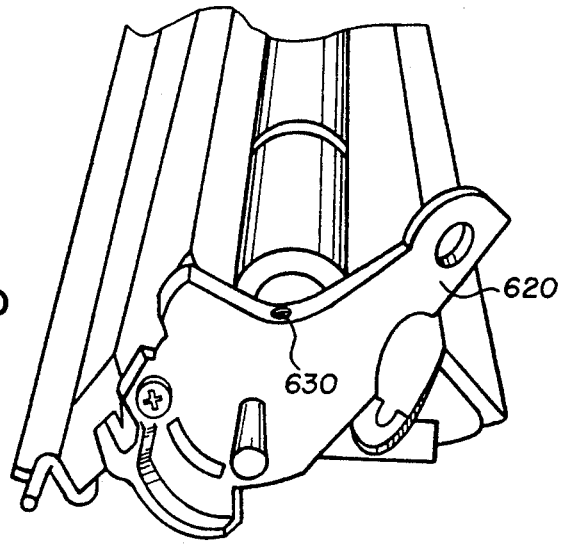

LASER PRINTER CARTRIDGES

BACKGROUND OF THE INVENTION

This invention relates to laser printers and more particularly to methods of manufacturing, calibrating, and remanufacturing laser printer cartridges.

The construction and operation of the print engine of a typical laser printer is shown in FIG. 1. Laser printers typically convert a laser signal 10 to a printed image by creating a latent image on a laser-sensitive-photosensitive drum 20 and developing the latent image into a visible image by applying toner powder to the latent image. The toner is transferred from a toner reservoir 30 to photosensitive drum 20 by a developer cylinder 40.

The photosensitive drum 20 is typically an extruded aluminum cylinder. In operation, the surface of the photosensitive drum carries a negative charge. The exterior surface of the photosensitive drum 20 is coated with a layer of an organic-photoconductive material (OPC). The OPC material acts as a photodiode; when exposed to light it becomes electrically conductive in one direction. The photosensitive drum 20 is electrically connected to ground in such a way that charge deposited on exposed portions of the surface of the drum can be conducted from the OPC layer, to the photosensitive drum, and to ground. When a region of the surface of the photosensitive drum 20 is illuminated it becomes conductive and charge is drained from that region (to ground). Areas on the surface of the photosensitive drum 20 which are not illuminated by the laser do not become photoconductive. In typical applications, the charge at a point on the surface which has not been illuminated is −600 V and the charge at a point which has been illuminated is −100 V. The difference in charges over the surface of the drum form a latent image.

The latent image on the surface of the photosensitive drum 20 is developed into a visible image by the application of toner to the laser-exposed regions of the photosensitive drum 20 by the developer cylinder 40. The developer cylinder 40 functions as a valve which regulates the transfer toner from a toner tank or reservoir 30 to the photosensitive drum 20. The developer cylinder 40 generally includes a rotating metallic sleeve 50 with a fixed magnetic member 60 positioned coaxially within the developer cylinder. The developer cylinder is positioned adjacent the photosensitive drum, with its axis parallel to that of the photosensitive drum. A toner cavity or reservoir is positioned adjacent to the developing cylinder 40. The toner generally consists of a fine powder of composite particles. The composite particles include a black plastic resin in which smaller particles of iron are encapsulated. As a point on the surface of the developer cylinder sleeve 50 rotates past the toner supply the magnetic member disposed within the rotating developer cylinder sleeve 50 attracts toner particles onto the surface of the developer cylinder sleeve 50. The depth of the layer of toner on the developer cylinder sleeve 50 is often controlled by a height-control metering blade 70, the gap between the blade and the surface of the developer cylinder controlling the thickness of the toner layer developer sleeve 50.

The developer cylinder 40 is connected to a negative power supply and thus the toner particles on the developing cylinder 40 acquire a negative surface charge. This charge is such that, as the developer cylinder sleeve 50 rotates and brings toner particles into close proximity to the photosensitive drum 20, the particles are attracted to the areas of the photosensitive drum which have been exposed (these areas have a charge of −100 v) and repelled from the areas which have not been exposed (these areas have a charge of −600 v). Transfer of the toner particles is further assisted by applying an AC potential to the developer cylinder 40. The AC potential contributes to overcoming the attraction between the toner particles and the internal magnetic member 60 of the developer cylinder 40 and helps to pull toner on the unexposed areas of the photosensitive drum 20 back to the developer cylinder. A visible image, formed by adherence of toner particles to illuminated areas of the photosensitive drum 20, is thus formed.

The visible image formed on the photosensitive drum 20 is then transferred to paper. Paper, traveling at the same speed at which the surface of the photosensitive drum 20 is rotating, is brought into contact with the photosensitive drum by pickup roller 80 and feed rollers 90. A transfer corona assembly 100, the long axis of which is parallel to the axis of the photosensitive drum 20, is positioned such that the paper passes between the photosensitive drum 20 and the transfer corona assembly 100. (A corona element ionizes the air surrounding it. Ionized air is a conductor of electricity thus the ionized region, or corona, allows a positive charge to migrate to the surface of the paper.) The transfer corona wire 105 produces and deposits a strong positive charge on the back of the paper (the surface not in contact with the pd). This positive charge results in the transfer of the negatively charged toner particles from the photosensitive drum 20 to the paper. As the paper and drum continue to move, the paper peels away from the photosensitive drum 20 and is fed by feeder 110 to a fusing station 120 where the toner is melted and forced into the paper by heat and pressure rollers 125.

After transfer of the image to the paper the rotation of the photosensitive drum 20 carries the region of the surface which has transferred its toner to paper to a cleaning station 130. The cleaning station prepares the surface of the photosensitive drum 20 for a new image. Leftover toner is removed by a urethane cleaning blade 140 which scrapes toner from the photosensitive drum 20 into a waste cavity 150. A sweeper blade 160 in the waste cavity 150 sweeps toner away from the area near the photosensitive drum 20. Erase lamps 170 electrostatically clean the photosensitive drum 20 by illuminating the OPC to neutralize residual charge.

Further rotation of the photosensitive drum 20 brings the cleaned surface to a conditioning station 180. Conditioning consists of the application of a uniform negative charge of −600 V on the surface of the photosensitive drum 20. This charge is deposited on the photosensitive drum 20 by the primary corona assembly 190. The primary corona assembly is positioned with its long axis parallel to the axis of the photosensitive drum 20.

The photosensitive drum 20, developer cylinder 40, toner, toner cavity 30, toner height metering blade 70, cleaner blade 140, waste cavity 150, and primary corona assembly 190 are often contained in a single module referred to as a developer of laser printer cartridge 200. The laser printer cartridge 200 is easily removed and replaced and contains the components most subject to wear or depletion, e.g., the photosensitive drum 20, developer cylinder 40, and toner.

SUMMARY OF THE INVENTION

In general, the invention features a laser printer cartridge, preferably a laser printer cartridge which uses single component toner, which includes: a housing; a photosensitive drum; a developer cylinder including an inner magnetic member and a coaxial outer sleeve, the internal magnetic member being adjustably mounted on the housing and the outer sleeve being mounted so as to allow rotation about the axis of the internal magnetic member and the outer sleeve; and means for adjustment of the angular position of the internal magnetic member with respect to the housing.

Preferred embodiments include those in which: the means for adjustment allows continuous adjustment of the angular position; the means for adjustment allows adjustment of the angular position in discrete steps; the means for adjustment allows adjustment of the angular position through 360 degrees of rotation of the internal magnetic member; the laser printer cartridge is compatible with laser printer machines which are compatible with non-adjustable laser cartridges; the internal magnetic member includes a first magnetic pole which can be aligned with the toner release point and a second magnetic pole which can be aligned with the toner pick-up point; the first magnetic pole has a magnetic strength of between approximately 50 and 70 gauss; and the second magnetic pole has a magnetic strength of between approximately 25 and 40 gauss.

In another aspect, the invention features a method of improving the performance of a laser printer cartridge, preferably a laser printer cartridge which uses single component toner, which includes: a housing; a photosensitive drum; a developer cylinder including an inner magnetic member including a first and a second magnetic pole and a coaxial outer sleeve, the internal magnetic member being adjustably mounted on the housing and the outer sleeve being mounted so as to allow rotation about the common axis of the internal magnetic member and the outer sleeve; and means for adjusting the angular position of the internal magnetic member with respect to the housing. The method includes adjusting the alignment of the first pole of the magnetic member with the toner release point and adjusting the alignment of the second pole of the magnetic member with the toner pick-up point.

Preferred embodiments include those in which: the adjustment of the first magnetic pole includes rotating the internal magnetic member and measuring the field strength of the first magnetic pole at a preselected point to determine whether the first pole is properly aligned with the release point; and the adjustment of the second magnetic pole includes rotating the internal magnetic member and measuring the field strength of the second magnetic pole at a preselected point to determine whether the second pole is aligned with the pickup point.

Other preferred embodiments include those in which: the method includes adjusting the first and second magnetic poles by rotating the internal magnetic member and measuring the field strength of the first magnetic pole at a preselected point and measuring the field strength of the second magnetic pole at a preselected point to determine whether the first and second poles are aligned with the release point and the pickup point respectively; and the measurement of the magnetic field of the first pole and the measurement of the magnetic field of the second pole can be made with the laser printer cartridge fully assembled.

Other preferred embodiments include those in which: the method includes rotating the internal magnetic member until the field strength of the first pole, as measured at a predetermined point, is within a predetermined range; rotating the internal magnetic member until the field strength of the second pole, as measured at a predetermined point, is within a predetermined range; rotating the internal magnetic member until the field strength of the first pole, as measured at a predetermined point, is within a predetermined range and the field strength of the second pole, as measured at a predetermined point, is within a predetermined range; and the measurement of the magnetic field of the first pole and the measurement of the magnetic field of the second pole can be made with the laser printer cartridge fully assembled.

Other preferred embodiments include those in which: the method includes rotating the internal magnetic member until the ratio of the measured field strength of the first pole to the measured field strength of the second pole is within a predetermined range; the measurement of the magnetic field of the first pole and the measurement of the magnetic field of the second pole can be made with the laser printer cartridge fully assembled; the method includes rotating the internal magnetic member and evaluating the printing performance of the laser printer cartridge.

In another aspect, the invention features a method of improving the performance of, or of remanufacturing, a laser printer cartridge, preferably a laser printer cartridge which uses single component toner, which includes a housing; a photosensitive drum; a developer cylinder including an inner magnetic member including a first and a second magnetic pole and a coaxial outer sleeve. The method includes installing in the laser printer cartridge an endcap including means for allowing free rotation of the developer cylinder sleeve about the common axis of the internal magnetic member and the outer sleeve and means for adjusting the angular position of the internal magnetic member.

Preferred embodiments include those in which: the method includes adjusting the first magnetic pole, the adjustment including rotating the internal magnetic member and measuring the field strength of the first magnetic pole at a preselected point to determine whether the first pole is properly aligned with the release point; the method includes adjusting the second magnetic pole, the adjustment including rotating the internal magnetic member and measuring the field strength of the second magnetic pole at a preselected point to determine whether the second pole is aligned with the pickup point.

Other preferred embodiments include those in which: the method includes adjusting the first and second magnetic poles, the adjustment including rotating the internal magnetic member and measuring the field strength of the first magnetic pole at a preselected point and measuring the field strength of the second magnetic pole at a preselected point to determine whether the first and second poles are aligned with the release point and the pickup point respectively; and the measurement of the magnetic field of the first pole and the measurement of the magnetic field of the second pole can be made with the laser printer cartridge fully assembled.

Other preferred embodiments include those in which: the method includes rotating the internal magnetic member until the field strength of the first pole, as measured at a predetermined point, is within a predetermined range; rotating the internal magnetic member until the field strength of the second pole, as measured at a predetermined point, is within a predetermined range; rotating the internal magnetic member until the field strength of the first pole, as measured at a predetermined point, is within a predetermined range and the field strength of the second pole, as measured at a predetermined point, is within a predetermined range; and the measurement of the magnetic field of the first pole and the measurement of the magnetic field of the second pole can be made with the laser printer cartridge fully assembled.

Other preferred embodiments include those in which: the method includes rotating the internal magnetic member until the ratio of the measured field strength of the first pole to the measured field strength of the second pole is within a predetermined range; the measurement of the magnetic field of the first pole and the measurement of the magnetic field of the second pole can be made with the laser printer cartridge fully assembled; the method includes rotating the internal magnetic member and evaluating the printing performance of the laser printer cartridge.

In another aspect, the invention features an endcap device for mounting a laser printer cartridge developer cylinder on a laser printer cartridge, preferably a laser printer cartridge which uses single component toner, wherein the developer cylinder includes a developer sleeve and an internal magnetic member positioned coaxially. The endcap includes: means for allowing free rotation of the developer cylinder sleeve about the internal magnetic member; means for allowing adjustable but fixed mounting of the internal magnetic member on the laser printer cartridge. In preferred embodiments the endcap is capable of being installed in the laser printer cartridge without other modification of the laser printer cartridge.

Laser printer cartridge, as used herein, refers to a module which contains a photosensitive drum, a developer cylinder, and preferably toner, more preferably single component toner. Preferably, the laser printer cartridge is removable from the printer to allow for easy replacement.

Angular positioning, as used herein, refers to the rotation of the internal magnetic member about its long axis, i.e., the axis which is coaxial with the long axis (the axis of sleeve rotation) of the developer cylinder. Angular positioning of a pole refers to the rotation of the pole about the above mentioned common axis.

Magnetic pole, as used herein, refers to a point on a magnet at which flux lines enter the magnet, i.e. a south pole, or leave a magnet, i.e. a north pole.

The alignment of a pole with a point, as used herein, refers to the angular position of the internal magnetic member, or one or more of its poles, or the field generated by a pole, with a point, e.g., the pickup point, the release point, or a preselected measurement point. Aligned with a point, as used herein, refers to an angular position of the internal magnetic member which results in the field strength, as measured at a preselected point, being within a predetermined range.

Adjusting the alignment of a pole, as used herein refers to the process of adjusting the angular position of the internal magnetic member such that the measured field strength of one or more of the poles of the member, or the ratio of the field strength of one pole to another pole, when measured at a predetermined point, falls with a predetermined range.

The alignment of the magnetic poles of the internal magnetic member of the developer cylinder of laser printer cartridge with other elements of the laser printer cartridge is often as much as 5–8 degrees or more from the point which gives optimum laser printer cartridge performance. Significant and undesirable misalignment is found in new, used, and remanufactured laser printer cartridges. The degree of misalignment found in laser printer cartridges is much greater than that typically found in copier machines. This misalignment, which can arise from a number of factors including manufacturing tolerances, wear, and batch-to-batch variations in characteristics, e.g., flow characteristics of toner, reduces laser printer cartridge performance, e.g., by reducing print-quality and/or decreasing the usable life of the laser printer cartridge.

The inventor has discovered that fine calibration of the angular position of the magnetic poles of the internal magnetic member of the developer cylinder of a laser cartridge can result in a surprising improvement in print quality and laser printer cartridge life. Variations arising from wear, manufacturing, tolerance, and batch to batch variations in toner characteristics can be corrected or compensated for by rotating the internal magnetic member with respect to other elements of the laser printer cartridge. The procedure results in a dramatic and surprising improvement in laser printer cartridge performance in both new and remanufactured laser printer cartridge units.

Methods and devices of the invention also allow for the rapid and economic modification of laser printer cartridges, e.g., by retrofitting, of new, used, or remanufactured laser printer cartridges with developer cylinder endcaps that allow adjustment of the angular position of the internal magnetic member. Endcaps and laser printer cartridges of the invention can be installed in laser printers without other modification of the laser printer.

Other features and advantages of the invention will be apparent from the following description and from the claims.

BRIEF DESCRIPTION OF THE DRAWINGS

The drawings are first briefly described.

FIG. 3 is a longitudinal sectional view of an adjustable interchangeable developer cylinder assembly.

FIG. 4*a* is a front view of a laser printer cartridge used, for example, in the Cannon SX printer refitted with adjustable endcaps.

FIG. 4*b* is an end view of the laser printer cartridge refitted with adjustable endcaps.

FIG. 5*b* is a front view of the internal magnetic member carrier for use with the end cap of FIG. 5*a*.

FIG. 5*c* is a front view of an electrical connector for use with the end cap of FIG. 5*a*.

FIG. 5*d* is a front view of the end cap of FIG. 5*a*.

DETAILED DESCRIPTION OF THE PREFERRED EMBODIMENT

Adjustable Laser Printing Cartridges

Figure 2:
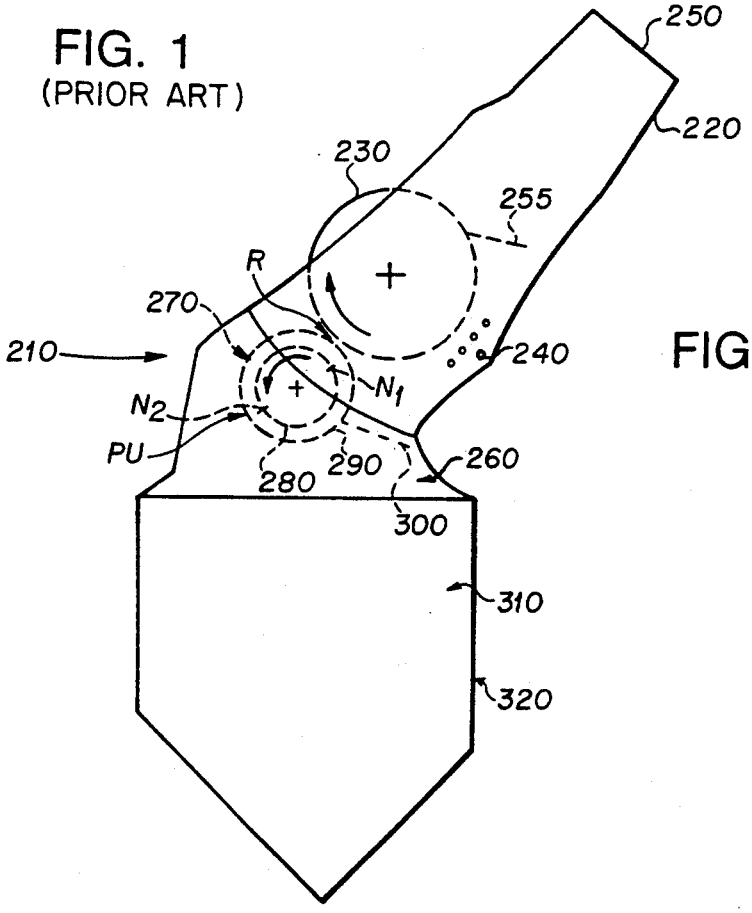
FIG. 2 is a simplified end view of a laser printer cartridge.

FIG. 2 depicts an end view of a laser printer cartridge 210 including a photosensitive drum housing 220, a photosensitive drum 230, a primary corona wire 240, a waste toner cavity 250, a scraper blade 255, a developer cylinder housing 260, a developer cylinder 270, which includes an internal magnetic member 280 and a developer sleeve 290, toner height metering blade 300, toner cavity 310, and toner cavity housing 320.

Figure 1:
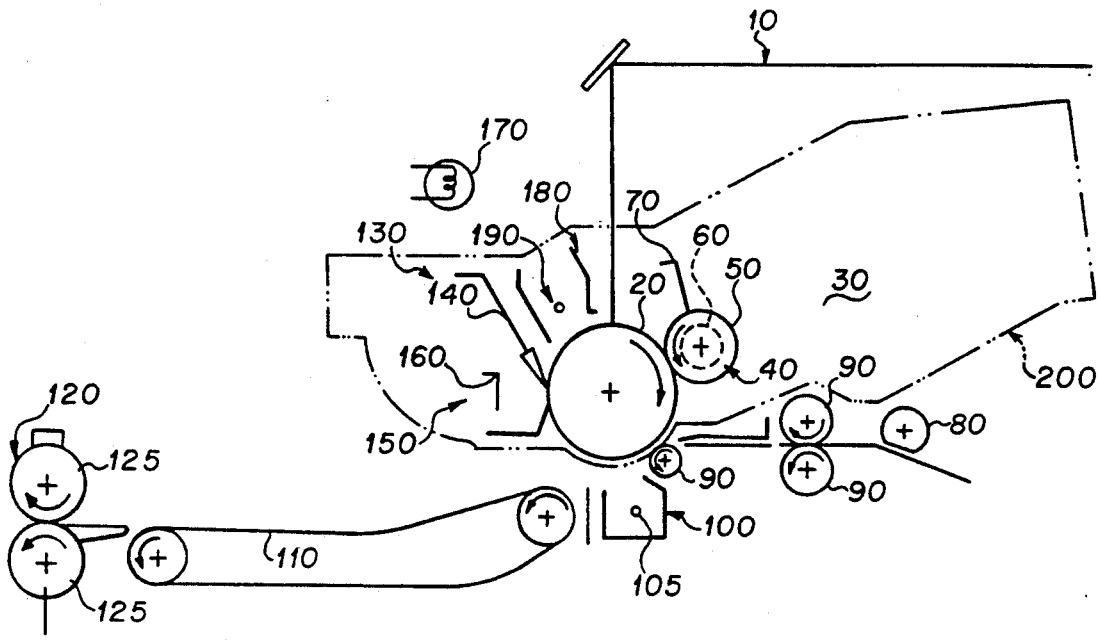
FIG. 1 (PRIOR ART)
FIG. 1 is a diagram of some of the major components of a prior art laser printer.

The photosensitive drum 230 is rotatably mounted on the photosensitive drum housing 320. The developer cylinder 270 is mounted on the developer cylinder housing 260 by developer cylinder endcaps (not shown in FIG. 1) located at each end of the developer cylinder. The developer sleeve 290 and the internal magnetic member 280 are coaxial and are both mounted on the developer cylinder housing 260. The developer sleeve 290 is mounted rotatably with respect to he internal magnetic member 280. Internal magnetic member 280 is mounted such that it is immobile (though adjustable) with respect to the rotation of developer sleeve 90.

During printing, the developer sleeve 290 rotates around the rigidly fixed internal member 280. As the developer cylinder sleeve 290 rotates past toner the pick up point PU, the magnetic pole $N_2$ of the internal magnetic member 280 causes toner to be attracted to the surface of the developer cylinder sleeve 290. As the developer cylinder sleeve 290 continues to rotate, the point on the surface which carries the toner just referred to moves to the release position R (which is usually the point at which developer cylinder sleeve 290 is closest to photosensitive drum 230). Toner is transferred, in part by the action of the magnetic pole $N_1$, to photosensitive drum 230 at release point R.

The angular rotation of internal magnet member 290 is adjustable, allowing precise adjustment of the alignment of poles $N_2$ and $N_1$ of internal magnetic member 280 with other components, e.g., the pickup and release points, respectively, of the laser printer cartridge or laser printer. The north and south poles of the internal magnetic member are interchangeable, i.e., the internal magnetic member can be positioned such that $S_1$ (not shown) replaces $N_1$ and $S_2$ (not shown) replaces $N_2$.

Any developer cylinder mounting means which allows free rotation of the developer cylinder sleeve and fixed but adjustable angular positioning of the internal magnetic member can be used with methods and devices of the invention. It is preferred, however, to use a developer cylinder mounting means which accomplishes such mounting without modification of the printer and without, other than the replacement of interchangeable parts, modification of the laser printer cartridge.

FIG. 3 is a longitudinal section of a developer cylinder assembly 410 with endcaps suitable for use with methods and devices of invention. The adjustable endcap 420 includes endcap body 430, mounting member 440, hold down screw 450, adjustable internal magnetic member carrier 460, internal magnetic member 480, developer cylinder sleeve 490, internal magnetic member carrier 510, drive endcap 500 which includes sleeve drive body 520, drive gear 530, and cap member 540 with mounting member 550.

The developer sleeve assembly 410 is attached to the laser printer cartridge or test bench by the mounting members 440, 550. One end of the internal magnetic member 480 is seated, e.g., pressed, into adjustable internal magnetic member carrier 460. The connection between internal magnetic member 480 and adjustable internal magnetic member 460 is such that the position of one is fixed with respect to the other. The adjustable internal magnetic member carrier 460 is seated rotatably into endcap body 430. Hold down screw 450 passes through a threaded aperture 475 in endcap body 430 to come into contact with adjustable internal magnetic member carrier 60. The developer sleeve 490 is seated rotatably into the annular groove formed by shoulder 425 on endcap body 430. The other end of the internal magnetic member 480 is seated, e.g., pressed, into internal magnetic member carrier 510, which is in turn rotatably seated into the drive endcap 100. The developer sleeve 490 is seated, rigidly with respect to drive endcap 500, in the annular groove formed by the shoulder 505 of drive endcap 500. The drive endcap 500 is seated rotatably into cap member 540. Adjusting tab 470, which is an extension of the internal magnetic member 480, extends through apertures in internal magnetic member carrier 510, sleeve drive body 520, drive gear 530, and cap member 540, allowing angular adjustment of internal magnetic member 480.

In operation the developer sleeve 490 is rotated by the gear 530 of the endcap 500. The internal magnetic member 480 is held fixed relative to the rotation of developer sleeve by 490 hold down screw 450. The angular position of the internal magnetic member 480 can be adjusted by backing off hold down screw 450, turning adjusting tab 470, then retightening hold down screw 50. The adjustable endcap 420, adjustable internal magnetic member carrier 460, drive endcap 500, and cap member 540 can be molded from ABS plastic. These parts are designed to replace nonadjustable endcap or similar mounting assemblies without modification of the developer sleeve 490 and without modification of the laser printer, and preferably without additional modification of the laser printer cartridge, in which the developer assembly is used.

FIG. 4*a* shows a portion of a Canon SX laser printer cartridge 610 which has been retrofitted with adjustable endcaps, including endcap body assembly 20, set screw 30, cylinder sleeve 460, and adjusting tab 650 (which is an extension of the internal magnetic member). Angular rotation of internal magnetic member (not visible in FIGS. 4*a* and *b*) is adjusted by backing off set screw 630, rotating adjusting tab 650, and tightening set screw 630. FIG. 4*b* shows an end view of a Canon SX laser printer cartridge refitted with adjustable endcap 620, including set screw 630.

Figure 5A:
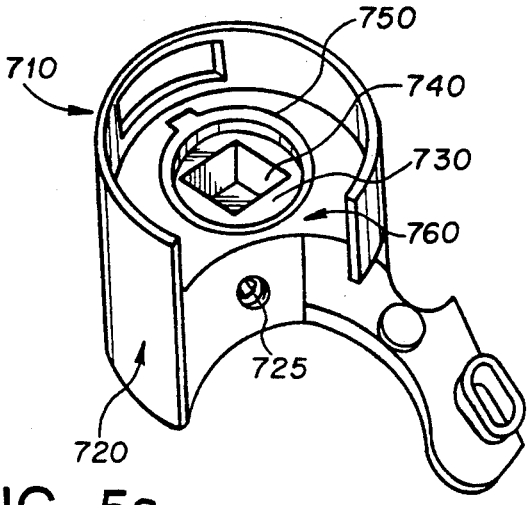
FIGS. 5*a*–5*d* show an adjustable internal magnetic member mounting device, or endcap, suitable for use with the laser printer cartridge.
Figure 5B:
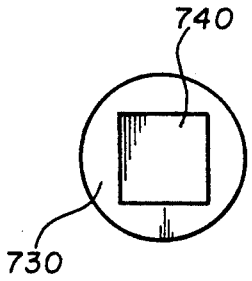
Figure 5C:
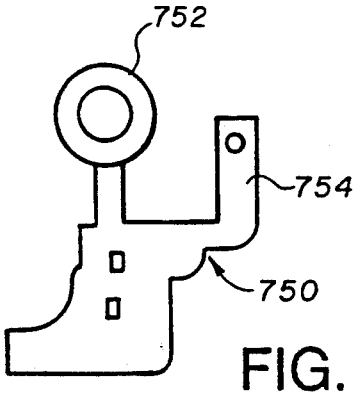
Figure 5D:
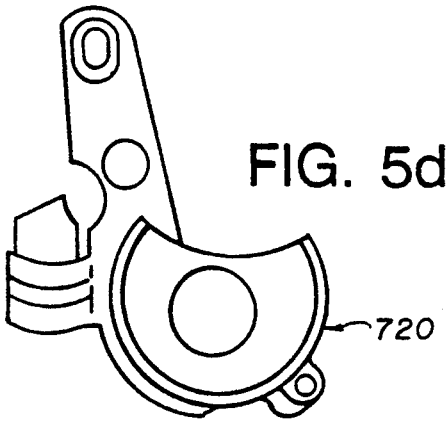

FIGS. 5*a*–5*d* show a mounting device, and components therefor, which allows adjustment of the angular position of the internal magnetic member. It can be used with Canon SX or similar laser printer cartridges. As shown in FIG. 5*a*, endcap 710 includes endcap body 720, set screw 725, rotatable internal magnetic member carrier 730 with internal magnetic member shaft receptacle 740, electrical connector 750, and internal magnetic member bearing receptacle 760. The shaft of the internal magnetic member is received by receptacle 740. Carrier 730 is rotatable within body 720 but can be immobilized by set screw 725. Receptacle 760 receives a bearing (not shown) which supports the developer cylinder (not shown). FIG. 5*b* shows a front view of internal magnetic member carrier 730 with receptacle 740. FIG. 5*c* shows a front view of electrical connector 750, prior to being formed to fit endcap body 720. Member 752 makes electrical connection to the developer cylinder (not shown) member 754 makes electrical connection with the metering blade (not shown). FIG. 5*d* is a front view of endcap body 720.

Figure 6A:
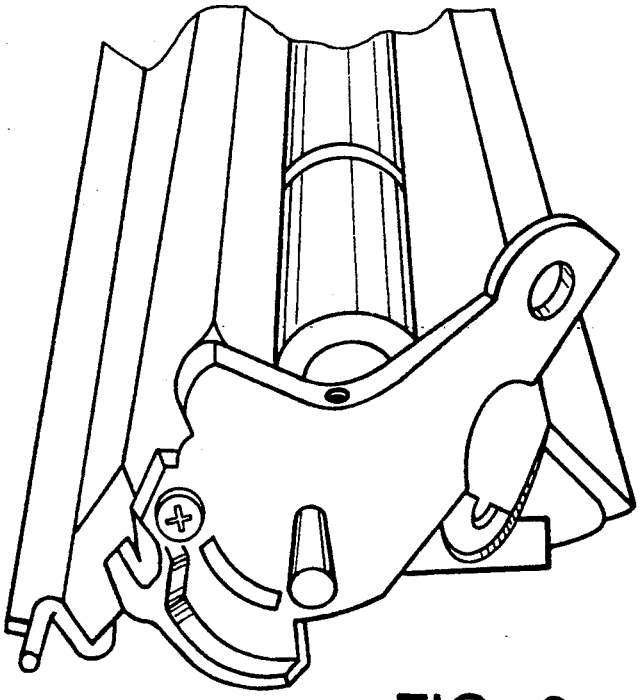
FIG. 6*a* is an end view of a portion of a Canon SX developer cylinder assembly retrofitted with an adjustable endcap.
Figure 6B:
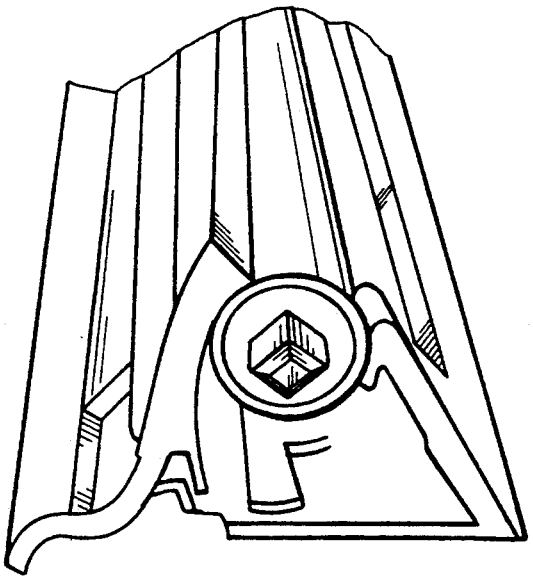
FIG. 6b (PRIOR ART)
FIG. 6*b* is an end view of a prior art Canon SX laser printer cartridge developer assembly.

FIG. 6*a* shows the adjustable endcap of FIG. 5*a* mounted on a Canon SX laser printer cartridge developer cylinder assembly. FIG. 6*b* is an endview of a Canon SX laser printer cartridge developer cylinder assembly with the original equipment nonadjustable endcap removed. The endcap allows free rotation of developer cylinder sleeve, holds internal magnetic member immobile during operation, and allows adjustment of the angular rotation of internal magnetic member with respect to other elements of the laser printer cartridge. The adjustable endcap can be incorporated into the developer cylinder of new or remanufactured laser printer cartridges.

Optimizing Laser Printer Cartridge Performance

Figure 7:
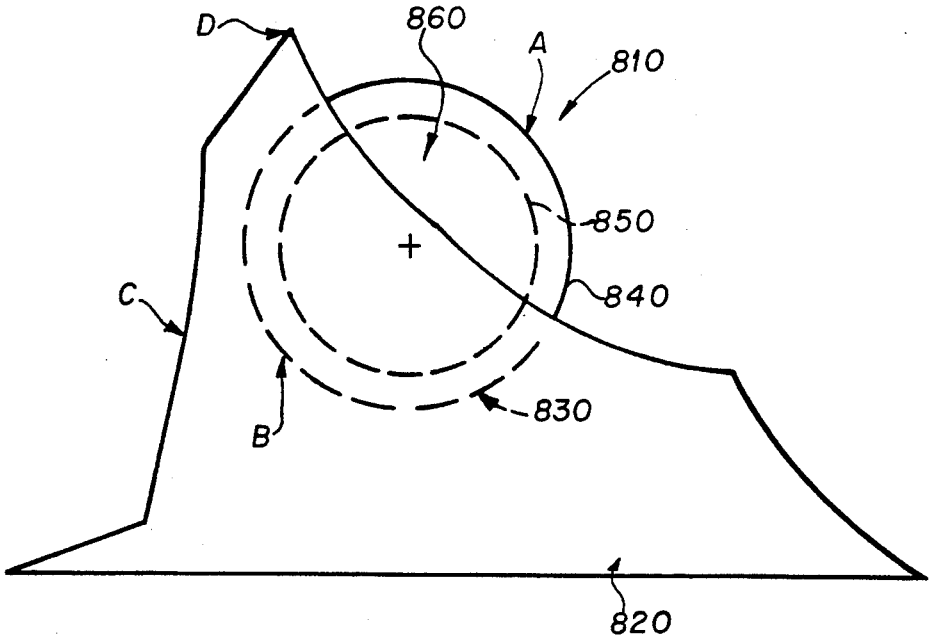
FIG. 7 is a somewhat schematic end view of portion of a laser printer cartridge.

FIG. 7 shows an end view of the developer cylinder section 810 of a laser printer cartridge including a developer cylinder housing 820, a developer cylinder 830, a developer cylinder sleeve 840, an internal magnetic member 850, and an adjustable endcap 860. Point A corresponds to the release point, i.e., the point on the circumference of the developer cylinder sleeve 840 at which toner is transferred to the photosensitive drum (not shown in FIG. 7). Point B corresponds to the pick-up point, i.e., the point on the circumference of the developer cylinder sleeve 40 at which toner is picked up, i.e., the point at which toner is transferred from the toner cavity to the developer cylinder sleeve 840. The internal magnetic member 850 includes magnetic poles (not shown), one of which is aligned with point A and the other of which is aligned with point B. By rotating the internal magnetic member 850 with respect to the developer cylinder housing 820, the alignment of the poles with respect to points A and B can be adjusted to optimize the performance of the laser printer cartridge.

Adjustment (i.e., rotation) of the internal magnetic member with respect to the developer cylinder housing (and other elements of the laser printer cartridge, e.g., the photosensitive drum and the toner cavity) alters the alignment of the poles of the internal magnetic member with points A and B, thus the magnetic field strength at points A and B. The magnetic field strength can be measured at points A and B, e.g., with a gaussometer. If A or B are not convenient then measurement can be made at a convenient point near the desired point. For example, as shown in FIG. 7, access to point B is made difficult by the design of the laser printer cartridge, thus a measurement can be taken at point C, where point C is close enough to point B that the field strength of the pole aligned with the pick-up point, as measured at C, is proportional, and preferably linearly proportional, to the field strength at point B. Likewise, measurement at point A is difficult then measurement can be taken at point D. Measurement at points C and D correspond to, and allow determination of, the position of the magnetic poles with respect to points A and B respectively.

The optimal values for the field strength at points A and B (or C, or D), and the optimum relationship between the field strengths at A and B (or C, and D), will vary with a number of considerations, including the exact point at which a measurement is made (e.g., how far from point A or B on the circumference of the developer cylinder is the measurement made), the strength of each magnetic pole, the model or type laser printer cartridge, the accuracy of original manufacturing tolerances, wear, batch-to-batch toner characteristics, and desired performance parameters. The optimum values for the above mentioned magnetic field measurements, and the optimum relationship between the values e.g., the optimum ratio of the two measured field strengths, can be determined by testing a given application (e.g., a chosen set of measurement positions, on a specific model laser printer cartridge, with a specific batch of toner) at various settings. The internal magnetic member is rotated through a range of positions. The print quality produced by each position and the corresponding field strengths are determined. An optimum value (or range of values) for field strength at the pick-up and release points, and the relationship between these values can thus be determined. Depending on the demands of the application the determination of optimum values and the relationship between the values can be made under more or less specific conditions. For example, it is possible to determine the optimum for a specific type or brand of laser printer cartridge and set all units of that type to those specifications. A more refined optimization would determine the optimum values and relationship for a specific type of laser printer cartridge and a specific batch of toner and or photosensitive drums. An even more specific optimization is one in which the optimum position for a specific laser printer cartridge unit is determined.

Figure 8:
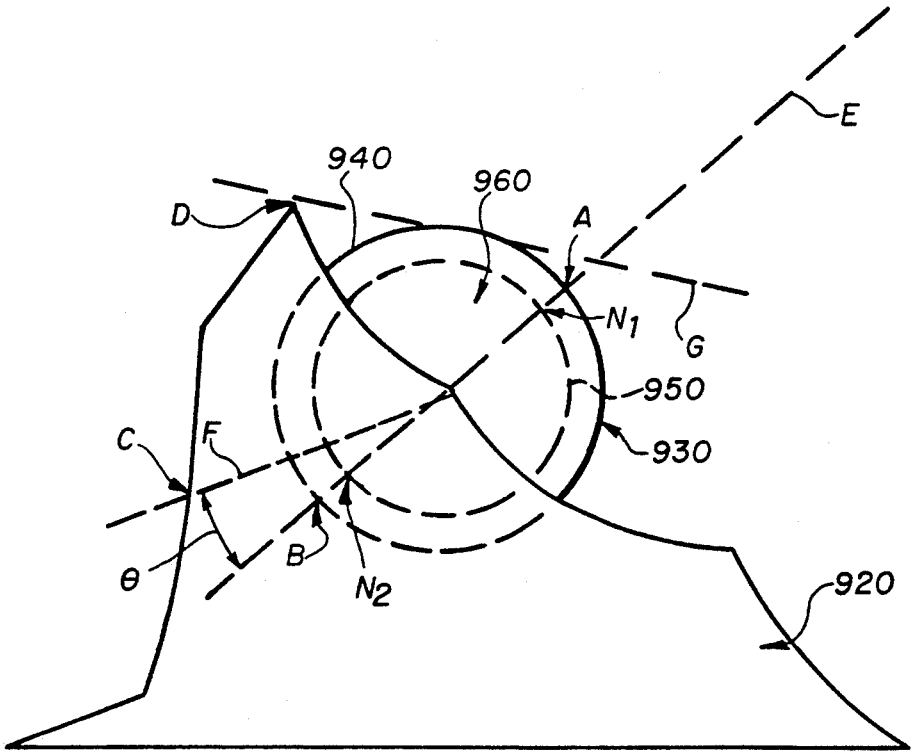
FIG. 8 is a somewhat schematic end view of a portion of a Canon SX laser printer cartridge with adjustable endcaps.

FIG. 8 is a simplified end view of the developer cylinder section of a remanufactured Canon SX laser printer cartridge which has been retrofitted with an adjustable endcap, including a developer cylinder housing 920, a developer cylinder 930, a developer cylinder sleeve 940, an internal magnetic member 950, with magnetic poles $N_1$, $N_2$, $S_1$ (not shown in FIG. 8), and $S_2$ (not shown in FIG. 8), and an adjustable endcap 960. The adjustable endcap 960 is similar to the endcap shown in FIG. 5. It allows free rotation of the developer cylinder sleeve 40 and adjustable positioning of the internal magnetic member 950. Adjustment of the positioning of internal magnetic member 950 is achieved by backing off the set screw, rotating the internal magnetic member 950 to a desired position, then tightening the set screw.

The adjustable endcap 960 may be installed at manufacture, or may be retrofitted to laser printer cartridges, e.g., during remanufacture. The magnetic pole $N_1$ is aligned with the toner release point (point A) and $N_2$ is aligned with the toner pickup point (point B). (Note that, as described above, north and south poles are interchangeable, i.e., the internal magnetic member can be rotated to replace $N_1$ with $S_1$ or $N_2$ with $S_2$.) Measurements of magnetic field strength were made at point C (for pick up) and at point D (for release). Line E is a line that intersects the centers of rotation of the developer cylinder and the photosensitive drum. Point C lies approximately at the surface of the developer cylinder housing on line F. Line F intersects the center of rotation for the developer cylinder and forms angle $\Theta$ with line E. Angle Θ is between approximately 15° and approximately 35°. Point D lies at approximately the surface of the developer cylinder housing on line G. Line G is approximately tangent to the developer sleeve surface and intersects line E at an angle of between approximately 100° and approximately 130°. These points were picked for convenience, other points can be used. Preferably, the points are chosen to allow measurement of both points in a fully assembled laser printer cartridge. Preferably, the points are picked such that a measurement taken at the point is proportional, preferably linearly proportional, to the field strength of the relevant magnetic pole at point A or B.

The internal magnetic member was rotated through a number of positions yielding different gauss values as measured at points C and D and the performance of the developer cylinder evaluated at each. Performance was evaluated by installing the laser printer cartridge in a Canon LBP8 MARK III laser printer and printing a test pattern. Optimum performance was found when the field strength measured at C was between approximately 5 and approximately 15, and preferably was approximately 7 gauss, and when the field strength measured at D was between approximately 0 and approximately 8 gauss, and was preferably approximately 4 gauss. In general good results were obtained when the ratio of the field strength measured at C to the field strength measured at D was between approximately 1.5 and 2.0, and preferably 1.7. As described above the optimal measured field strengths and ratios will vary with a variety of conditions, e.g., with the chosen measurement points, and can be determined as described herein.

Remanufacture of Laser Printer Cartridges

A protocol for remanufacturing laser printer cartridges can include any or all of the following steps:

I. Unpackaging

1. Each cartridge is inspected for exterior damage and drum damage.
2. Each cartridge is identified with a travel label.

II. Pretest

1. Each cartridge is tested in a printer to insure quality print.

III. Disassembly of Cartridge

1. Exterior components are thoroughly cleaned and inspected, worn and/or damaged parts are replaced.
2. Interior components e.g., the photosensitive drum, are thoroughly cleaned and inspected, worn and/or damaged parts are replaced.
3. Collector tank is completely emptied, checked for proper function, wiper blade is inspected and adjusted for proper operation.
4. Toner reservoir is completely emptied, developer roll is inspected and doctor blade is adjusted to proper gap from developer roll.
5. A new toner retaining slide seal is installed to prevent leakage into the drum area during shipping and handling.
6. Toner reservoir is replenished with high quality high density toner.

IV. Reassemble

1. A label is attached to the interior of the cartridge to indicate toner batch, number of times cartridge has been recycled, date and operator.
2. Adjustable endcap assemblies are installed and the cartridge reassembled.
3. The optimum angular position of the internal magnetic member is determined as described above. The internal magnetic member is rotated to optimize performance (either by rotating to achieve a predetermined set of values, or by rotating the internal magnetic member and checking print quality). Generally, a set of optimum values will be determined for a given toner batch and/or photosensitive drum density. All cartridges will be set to these values.

V. Final Test

1. Each cartridge is tested in a printer for proper function and print quality.
2. If necessary the angular position of the internal magnetic member is recalibrated to improve printing performance.
3. Each cartridge is shipped with the final test sheet attached.

VI. Packaging

1. Each cartridge is sealed in an opaque bag.
2. The fixed cleaner wand is refelted or replaced as needed.

OTHER EMBODIMENTS

Other embodiments are within the following claims.

For example, the endcaps discussed above allow continuous adjustment of the angular position of the internal magnetic member (and thus the magnetic poles of the internal magnetic member) with respect to other elements of the laser printer cartridge. Other embodiments may allow for adjusting the angular position into discrete defined positions. Some laser printer cartridges have internal magnetic members with rectangular shafts which are held by complimentary rectangular recesses in nonadjustable endcaps. In these devices, the internal magnetic member can be rotated 90°, 180°, or 270° (i.e., to the three alternative positions possible when a square shaft is held in a complementary square recess on a mounting device) to optimize laser printer cartridge performance.

Two hundred fifty used Canon SX laser printer cartridges were remanufactured. Remanufacture included replenishing toner, replacement of photosensitive drum if necessary, installing adjustable endcaps, and optimization of the alignment of the internal magnetic member by rotating the magnetic member 90°, 180°, or 270°. All 250 of the remanufactured laser printer cartridges were capable of high quality graphic printing. Approximately 50% of ne Canon SX laser printer cartridges produced unacceptable or marginally acceptable graphics printing.

What is claimed is:

1. A laser printer cartridge comprising:

a housing;

a toner supply located in the housing;

a photosensitive drum rotatably mounted in the housing on a first axis of rotation;

a developer cylinder rotatably mounted in the housing on a second axis of rotation parallel to the first axis of rotation, the developer cylinder rotating relative to a toner pickup region located adjacent the toner supply, wherein toner is transferred to the developer cylinder from the toner supply, and a toner release region located adjacent the photosensitive drum, wherein toner is transferred from the developer cylinder to the photosensitive drum;

a metering structure located adjacent the developer cylinder between the toner pickup region and the toner release region, said structure removing from the developer cylinder excess toner thereon transferred from the pickup region, to provide a metered depth of toner on the developer cylinder;

a magnetic member located internal to and coaxial with the developer cylinder, establishing therein magnetic poles, the magnetic member being rotationally fixed on the second axis of rotation relative to the developer cylinder; and a pair of end caps supporting each of the developer cylinder and the magnetic member, at opposite ends thereof, in the housing, at least one of the end caps and the magnetic member being constructed and arranged so that the magnetic member is freely rotatable on the second axis of rotation relative to the housing and is fixable in a desired rotational orientation relative to the housing whereby the magnetic poles are adjustably positionable to a desired rotational location relative to the pickup region and the release region, allowing control of a magnetic field at the pickup region and the release region.

2. The laser printer cartridge of claim 1, wherein the at least one of the end caps and the magnetic member is constructed and arranged to allow continuous rotation of the magnetic member relative to the housing.

3. The laser printer cartridge of claim 1, wherein the at least one of the end caps and the magnetic member is constructed and arranged to allow rotation of the magnetic member relative to the housing through 360° of rotation.

4. The laser printer cartridge of claim 1, further characterized in that said laser printer cartridge is compatible with laser printer machines which are compatible with laser printer cartridges having nonfreely rotatable and nonrotationally adjustable magnetic members.

5. The laser printer cartridge of claim 1, wherein the magnetic poles of the magnetic member comprise a first magnetic pole located relative to the toner release region and a second magnetic pole located relative to the toner pickup region.

6. The laser printer cartridge of claim 5, wherein a magnetic field at the first magnetic pole has an amplitude of between approximately 50 and 70 gauss.

7. The laser printer cartridge of claim 5, wherein a magnetic filed at the second magnetic pole has an amplitude of between approximately 25 and 40 gauss.

8. A method for optimizing toner consumption of a laser printer cartridge having a housing containing a toner supply, a rotating photosensitive drum, a rotating developer cylinder in contact with the toner supply at a toner pickup region and in contact with the photosensitive drum at a toner release region, and a magnetic member having magnetic poles rotationally fixed relative to the housing and coaxial with and internal to the developer cylinder comprising the steps of:

freely rotating the magnetic member to a rotational orientation relative to the housing so that a respective desired magnetic field is present at each of the toner pickup region and the toner release region so that an optimum quantity of toner is transferred from the toner supply by the developer cylinder to the photosensitive drum; and fixing the rotational orientation of the magnetic member so that the magnetic poles are maintained at desired rotational positions.

9. The method of claim 8, wherein the magnetic poles comprise a first magnetic pole and a second magnetic pole and wherein the freely rotating of the magnetic member comprises rotating the magnetic member and measuring the strength of the magnetic field of the first magnetic pole at a predetermined point and determining whether the first pole is located at the desired rotational position relative to the release point.

10. The method of claim 8, wherein the magnetic poles comprises a first magnetic pole and a second magnetic pole and wherein the freely rotating of the magnetic member comprises rotating the magnetic member and measuring the strength of the magnetic field of the second magnetic pole at a predetermined point to determine whether the second magnetic pole is located at the desired rotational position relative to the pickup point.

11. The method of claim 8 wherein the magnetic poles comprise a first magnetic pole and a second magnetic pole and wherein the freely rotating of the magnetic member comprises rotating the magnetic member and measuring the strength of the magnetic filed of the first magnetic pole at a predetermined point and measuring the strength of the magnetic filed of the second magnetic pole at a predetermined point to determine whether the first magnetic pole and the second magnetic pole are each located at the desired respective rotational position relative to each of the release point and the pickup point respectively.

12. The method of claim 11, wherein the measuring of the strength of the magnetic field at the first pole and the measuring of the strength of the magnetic field of the second pole are each accomplished when the laser printer cartridge is in a fully assembled state.

13. The method of claim 8, wherein the magnetic poles comprise a first magnetic pole and a second magnetic pole and wherein the freely rotating of the magnetic member comprises rotating the magnetic member so that strength of the magnetic field of at least one of the first magnetic pole and the second magnetic pole, as measured at a predetermined point, is within a predetermined range of field strengths.

14. The method of claim 13, wherein the predetermined range is chosen based upon a magnetic field strength value that optimizes consumption of toner by the developer cylinder.

15. The method of claim 14, wherein the freely rotating of the magnetic member includes the step of providing a modified end cap to at least one end of the magnetic member, the end cap including an orifice that enables contact with an adjustment structure connected to the magnetic member, and rotating the adjustment structure to rotate the magnetic member.

16. The method of claim 15, wherein the step of providing a modified end cap includes providing a cylindrical surface upon which a portion of the magnetic member supported by the end cap can freely rotate.

17. The method of claim 16, wherein the step of providing the modified end cap further comprises removing a predetermined surface for supporting an end of the magnetic member in a rotationally fixed orientation and substituting the cylindrical surface to support the magnetic member in a freely rotatable state.

18. A method for remanufacturing a laser printer cartridge having a housing, a toner supply, a rotating photosensitive drum and a developer cylinder in contact with each of the toner supply and the photosensitive drum and rotatably supported in the housing on end caps, the method comprising the steps of:

disassembling the housing to remove each of the photosensitive drum and the developer cylinder;

disassembling the end caps of the developer cylinder and exposing an internal magnetic member coaxial with the developer cylinder, the internal magnetic member having magnetic poles, at least one of the end caps including a predetermined surface that maintains the magnetic member in a predetermined fixed rotational orientation relative to the housing;

providing at least one replacement end cap constructed and arranged to enable free rotation of the magnetic member relative to the housing;

reattaching the at least one replacement end cap to the developer cylinder with the internal magnetic member positioned inside and coaxially therewith;

reassembling the housing including reattaching each of a photosensitive drum and the developer cylinder including the at least one replacement end cap to the housing and replenishing the toner supply;

rotating the magnetic member freely relative to the housing so that a desired magnetic field is present at each of respective desired rotational positions relative to the housing whereby transfer of toner from the toner supply to the developer cylinder and from the developer cylinder to the photosensitive drum is optimized; and fixing the magnetic member so that the magnetic poles are maintained at the desired rotational positions relative to the housing.

19. The method of claim 18 wherein the rotating of the magnetic member further comprises measuring a strength of a magnetic field of at least one of the magnetic poles at a predetermined point to determine whether the at least one of the poles is located at a desired rotational position relative to the housing.

20. The method of claim 18, wherein the rotating of the magnetic member includes locating each of the magnetic poles at a desired rotational position relative to a contact point of the developer cylinder with at least one of the toner supply and the photosensitive drum.

21. The method of claim 18, wherein the fixing of the magnetic member includes tightening a set screw located on at least one of the end caps so that the set screw engages a portion of the magnetic member.

22. The method of claim 18, further comprising providing a structure to at least one end of the magnetic member adjacent the at least one replacement end cap that enables engagement of the magnetic member and rotation of the magnetic member relative to the housing.

23. The method of claim 22, wherein the providing of the structure comprises providing a shaft having a predetermined surface for engaging an adjustment tool and wherein the rotating of the magnetic member further comprises engaging the shaft with the adjustment tool and rotating the adjustment tool to rotate the magnetic member.

24. The method of claim 18, wherein the rotating of the magnetic member includes measuring a strength of a magnetic field of each of the magnetic poles at a predetermined point and locating each of the magnetic poles at the desired rotational position based upon a predetermined ratio of measured field strength of each of the magnetic poles relative to another of the magnetic poles.

25. End caps for a removable laser printer cartridge that is constructed and arranged to be replaceably mountable in a laser printer and including a housing, a toner supply located in the housing, a photosensitive drum rotatably mounted in the housing on a first axis of rotation, a developer cylinder rotatably mounted on the housing on a second axis of rotation parallel to the first axis of rotation, wherein the developer cylinder includes a toner pickup region located adjacent the toner supply and a toner release region located adjacent the photosensitive drum and the developer cylinder further including a magnetic member located internal of and coaxial with the developer cylinder, the magnetic member including magnetic poles and being rotationally fixed on the second axis of rotation relative to the developer cylinder, a metering structure adjacent the developer cylinder located between the toner pickup region and the toner release region, wherein the end caps are rotatably supporting the developer cylinder relative to the magnetic member at opposing ends thereof, the end caps comprising:

a first supporting surface constructed and arranged to enable free rotation of the developer cylinder relative to the end caps and the housing; and a second supporting surface for supporting the magnetic member coaxial with and internal of the developer cylinder, the second supporting surface including a surface shape that enables the magnetic member to rotate freely relative to each of the end caps and the housing and that enables external engagement of at least a portion of the magnetic member to freely rotate the magnetic member on the second axis relative to each of the end caps and the housing, the end caps further including a locking structure that enables the magnetic member to be fixed in a desired rotational orientation relative to the housing.

26. The end caps of claim 25, wherein each of the end caps includes a cylindrical surface and the internal magnetic member includes end shafts that rotatably engage the cylindrical surfaces so that the internal magnetic member rotates freely relative to the end caps.

27. The end caps of claim 25, wherein at least one of the end caps includes an orifice for exposing a portion of the magnetic member so that the magnetic member can be engaged to freely rotate the magnetic member.

28. The end caps of claim 25, wherein at least one of the end caps includes a locking structure for fixing the magnetic member in a predetermined rotational orientation relative to the housing.

* * * * *